US010012191B2

(12) United States Patent
Montgomery et al.

(10) Patent No.: US 10,012,191 B2
(45) Date of Patent: Jul. 3, 2018

(54) FUEL INJECTOR WIRING HARNESS TRAY

(71) Applicant: Caterpillar Inc., Peoria, IL (US)

(72) Inventors: Andrew Montgomery, Peoria, IL (US); Srinivas R. Mutchyala, Peoria, IL (US); Stephen Sonnenberg, Washington, IL (US); Leonard Hilbert, Peoria, IL (US); Gabriela David, Peoria, IL (US); Jayant Roplekar, Peoria, IL (US); Seth Studnicka, Chillicothe, IL (US)

(73) Assignee: Caterpillar Inc., Deerfield, IL (US)

( * ) Notice: Subject to any disclaimer, the term of this patent is extended or adjusted under 35 U.S.C. 154(b) by 253 days.

(21) Appl. No.: 15/152,247

(22) Filed: May 11, 2016

(65) Prior Publication Data

US 2017/0328320 A1 Nov. 16, 2017

(51) Int. Cl.
*F02M 51/00* (2006.01)

(52) U.S. Cl.
CPC ..... *F02M 51/005* (2013.01)

(58) Field of Classification Search
CPC ..... F02M 51/005
See application file for complete search history.

(56) References Cited

U.S. PATENT DOCUMENTS

| | | | | |
|---|---|---|---|---|
| 5,285,754 | A * | 2/1994 | Bell | F01M 13/0416 123/195 C |
| 5,642,704 | A * | 7/1997 | Gogots | F02B 77/00 123/196 R |
| 5,771,850 | A * | 6/1998 | Okada | F02F 7/006 123/143 C |
| 6,672,272 | B2 * | 1/2004 | McGloin | F02F 7/006 123/195 C |
| 2004/0000292 | A1 * | 1/2004 | Bodenhausen | F02M 35/10078 123/456 |
| 2004/0074464 | A1 * | 4/2004 | Zwick | F02D 41/3005 123/143 C |
| 2013/0104837 | A1 | 5/2013 | Sengstock et al. | |
| 2014/0238331 | A1 | 8/2014 | Saito et al. | |

* cited by examiner

*Primary Examiner* — Sizo Vilakazi
(74) *Attorney, Agent, or Firm* — Miller, Matthias & Hull

(57) ABSTRACT

A tray configured to support a fuel injector wiring harness is disclosed. The tray may include a first end, a second end opposite the first end, a bottom wall extending between the first end and the second end, and the bottom wall may be configured to support the fuel injector wiring harness above a rocker arm support. Moreover, the tray may include a tab outwardly extending from the tray, and the tab may include a top surface, a bottom surface opposite the top surface, and an aperture extending between the top surface and the bottom surface. The aperture may be configured to circumscribe a stud upwardly extending from the rocker arm support.

20 Claims, 7 Drawing Sheets

FUEL INJECTOR WIRING HARNESS TRAY

TECHNICAL FIELD

This disclosure generally relates to a wiring harness tray for an internal combustion engine and, more particularly, to a fuel injector wiring harness tray for an internal combustion engine.

BACKGROUND

Internal combustion engines, such as, but not limited to, Otto and Diesel cycle engines, are used in a variety of applications. Generally speaking, internal combustion engines include an air intake system, a fuel system, an exhaust system and an electrical system. More specifically, the fuel system includes a fuel line configured to carry a fuel from a fuel source to a fuel injector, and the fuel injector is configured to receive an electrical signal and deliver the fuel to a cylinder in response to the electrical signal. Furthermore, the electrical system includes a fuel injector wiring harness configured to convey the electrical signal to the fuel injector.

As is depicted and described in US patent application having publication number US 2004/0000292 ("Bodenhausen"), it is known to position a fuel injector wiring harness configured to convey the electrical signal to the fuel injector. More specifically, and as is described and depicted therein, the fuel injector wiring harness is fastened to the fuel line via one or more clips outwardly extending from the fuel line. This arrangement presents limitations to the operation of internal combustion engines, especially when separation of the fuel line from the fuel injector wiring harness is required. Moreover, such an approach adds parts and labor in terms of manufacturing and maintenance, thereby increasing cost and decreasing reliability.

The present disclosure is directed to overcoming one or more problems set forth above and/or other problems associated with the prior art.

SUMMARY

In accordance with one aspect of the present disclosure, a tray configured to support a fuel injector wiring harness is disclosed. The tray may include a first end, a second end opposite the first end, a bottom wall extending between the first end and the second end, and the bottom wall may be configured to support the fuel injector wiring harness above a rocker arm support. Moreover, the tray may include a tab outwardly extending from the tray, and the tab may include a top surface, a bottom surface opposite the top surface, and an aperture extending between the top surface and the bottom surface. The aperture may be configured to circumscribe a stud upwardly extending from the rocker arm support.

In accordance with another aspect of the present disclosure, a cylinder head is disclosed. The cylinder head may include a valve system, a rocker system operationally engaged with the valve system, and the rocker system includes a rocker arm support. Furthermore, a stud may upwardly extend from the rocker arm support. Additionally, the cylinder head may include a fuel injector and a fuel injector wiring harness configured to convey an electrical signal to the fuel injector. Furthermore, the cylinder head may include a tray configured to support the fuel injector wiring harness above the rocker arm support. The tray may include a first end, a second end opposite the first end, a bottom wall extending between the first end and the second end, and a tab outwardly extending from the tray. Moreover, the tab may include a top surface and a bottom surface opposite the top surface and have an aperture extending therethrough configured to circumscribe the stud upwardly extending from the rocker arm support.

In accordance with another embodiment of the present disclosure, an internal combustion engine is disclosed. The internal combustion engine may include an engine block and a cylinder head supported by the engine block. The cylinder head may include a valve system, a rocker system operationally engaged with the valve system including a rocker arm support and a stud upwardly extending from the rocker arm support. Moreover, the cylinder head may include a fuel injector, a fuel injector wiring harness configured to convey an electrical signal to the fuel injector, and a tray configured to support the fuel injector wiring harness above the rocker arm support. Furthermore, the tray may include a first end, a second end opposite the first end, and a bottom wall extending between the first end and the second end, and a tab outwardly extending from the tray. In addition, the tab may include a top surface, a bottom surface opposite the bottom surface and have an aperture extending therethrough configured to circumscribe the stud upwardly extending from the rocker arm support These and other aspects and features of the present disclosure will be more readily understood when read in conjunction with the accompanying drawings.

BRIEF DESCRIPTION

Figure 1:
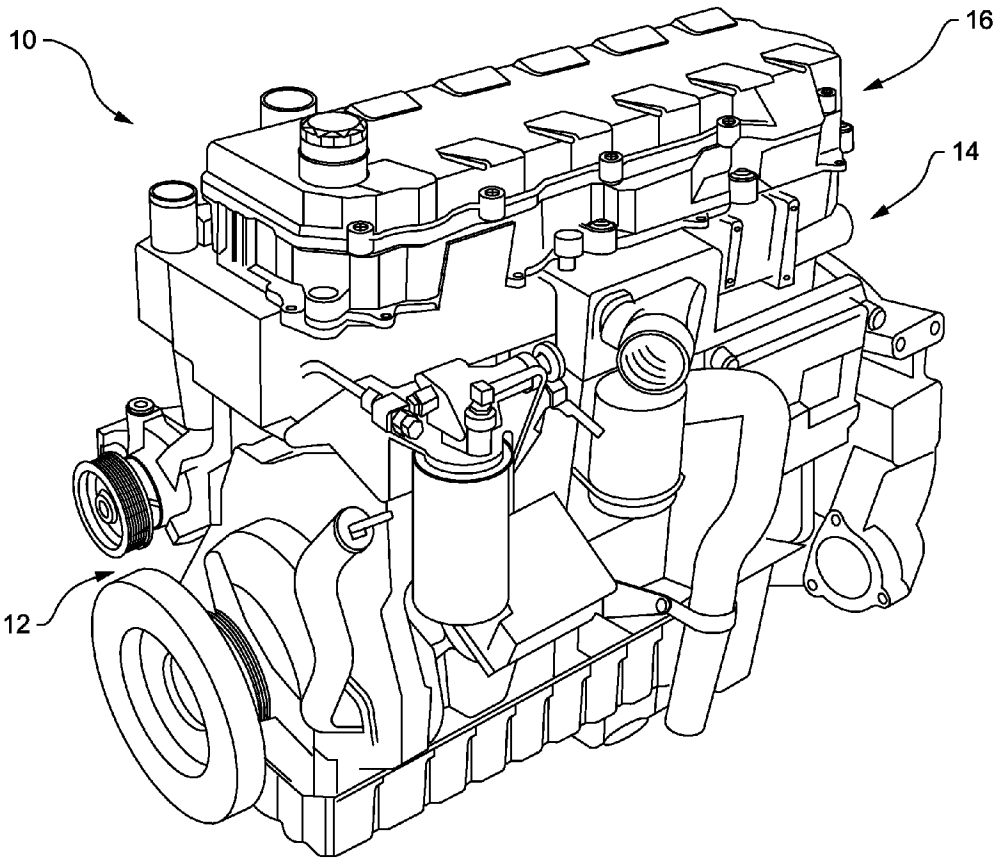
FIG. 1 is a perspective view of an internal combustion engine manufactured in accordance with the present disclosure.
Figure 2:
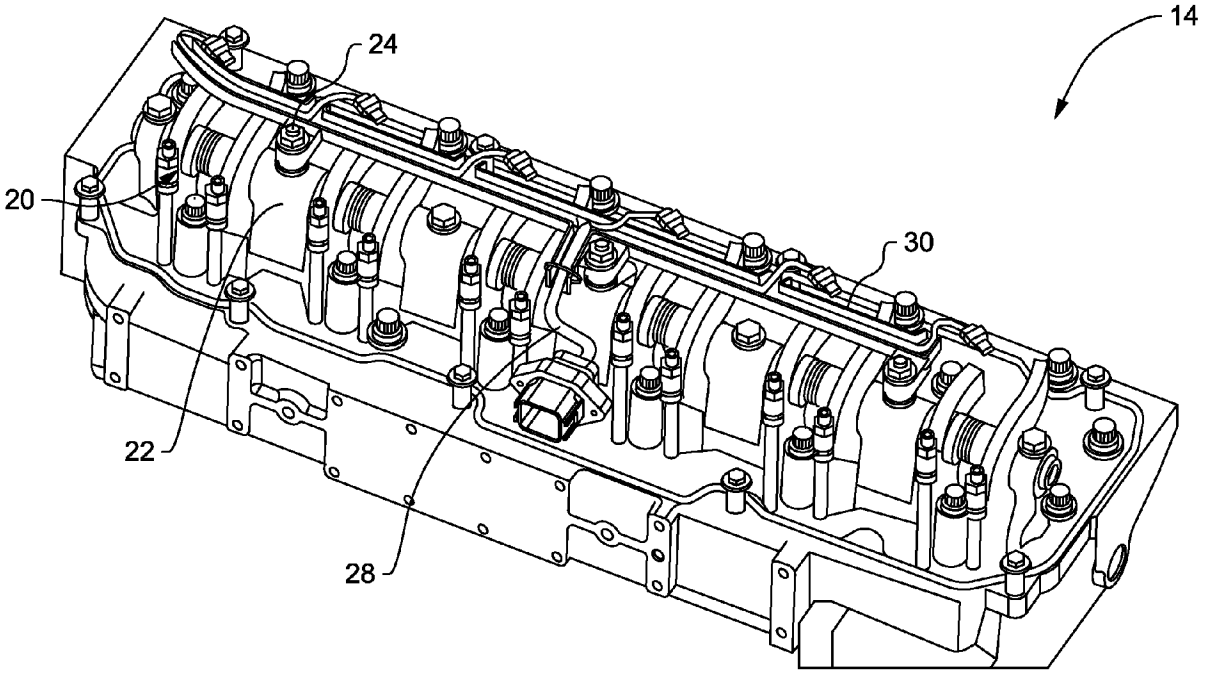
FIG. 2 is a perspective view of a cylinder head that may be utilized with the internal combustion engine according to FIG. 1, with a valve cover removed, looking from a rocker-side towards a valve-side.
Figure 3:
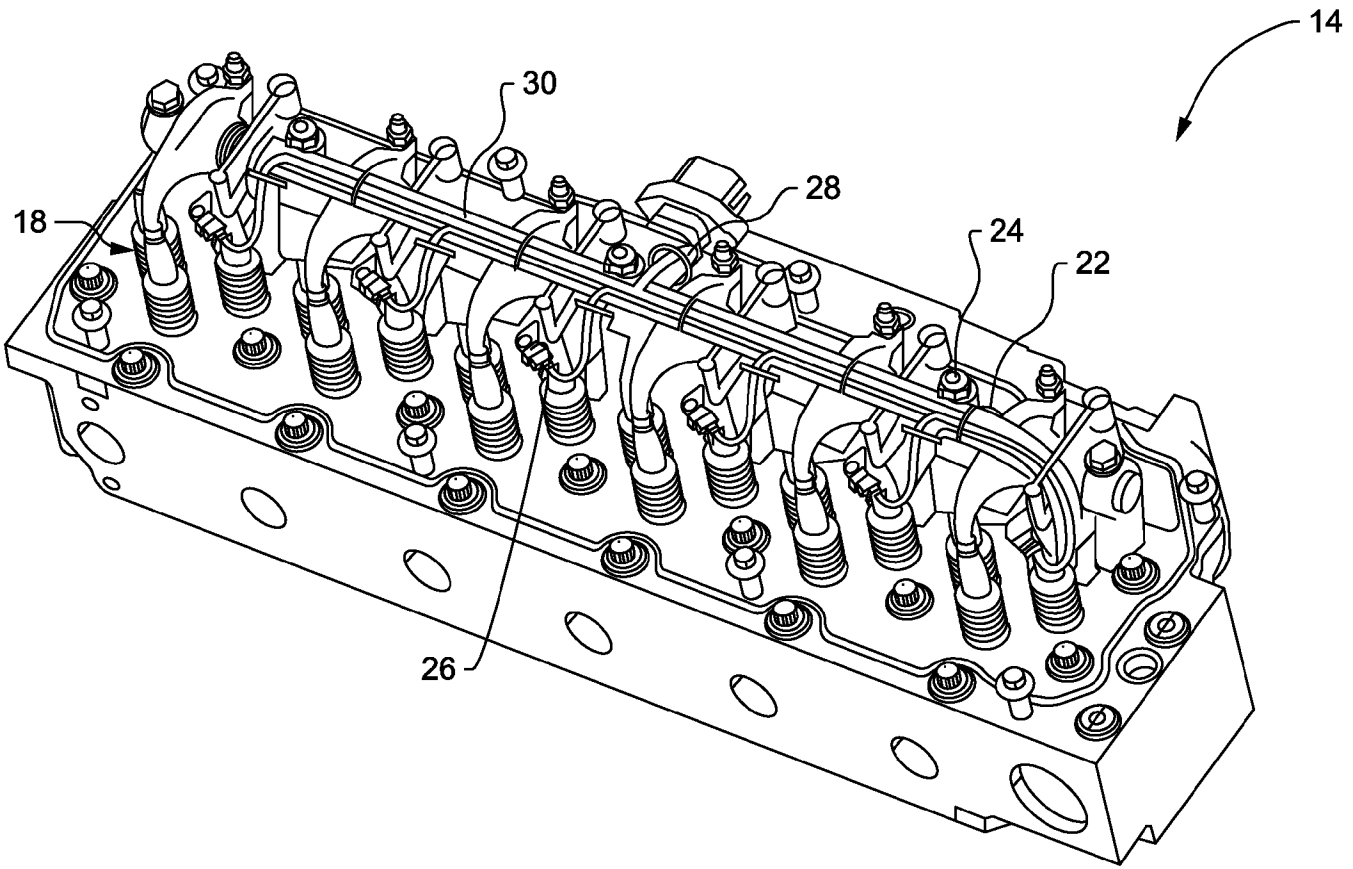
Figure 4:
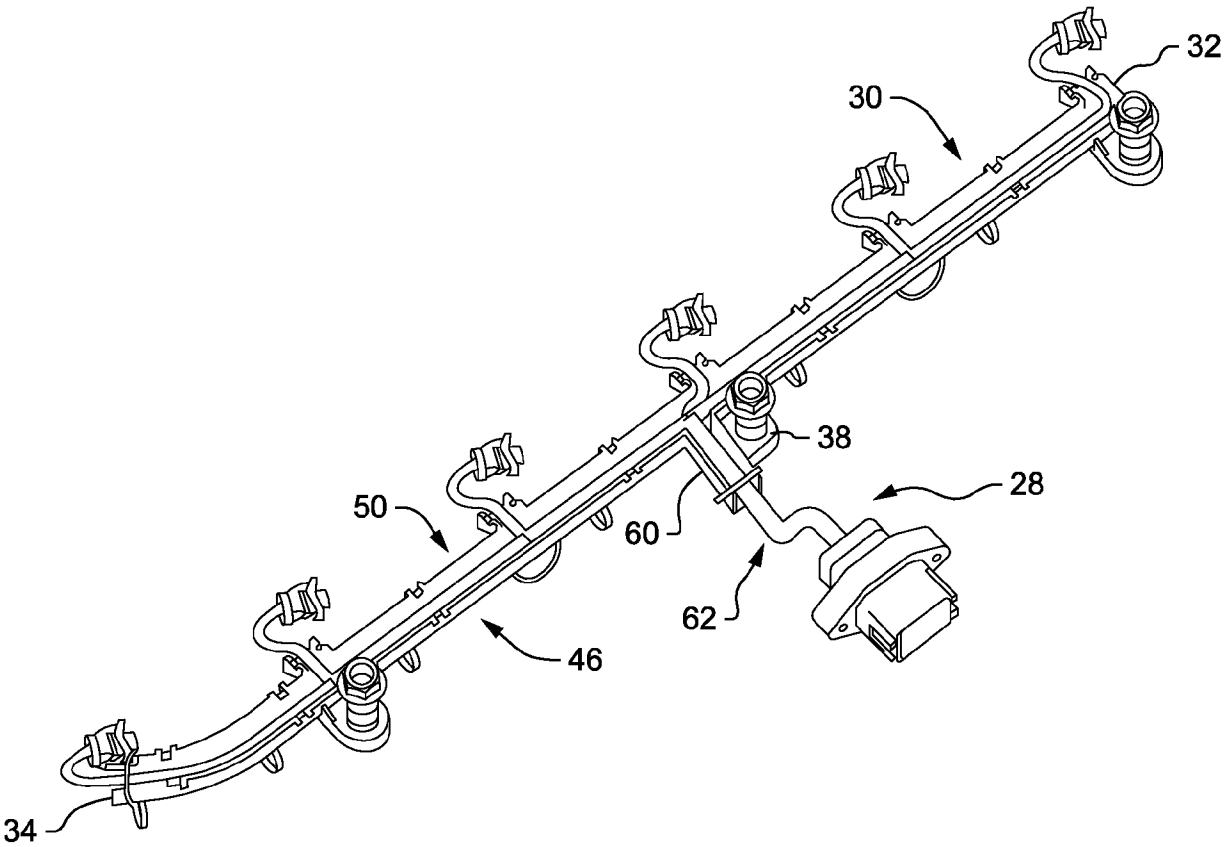

FIG. 3 is a perspective view of a cylinder head that may be utilized with the internal combustion engine according to FIG. 1, with a valve cover removed, looking from a valve-side towards a rocker-side FIG. 4 is a perspective view of a tray configured to support a fuel injector wiring harness, and the fuel injector wiring harness, that may be utilized with the cylinder head of FIGS. 2 and 3 looking from a rocker-side to a valve-side.

Figure 5:
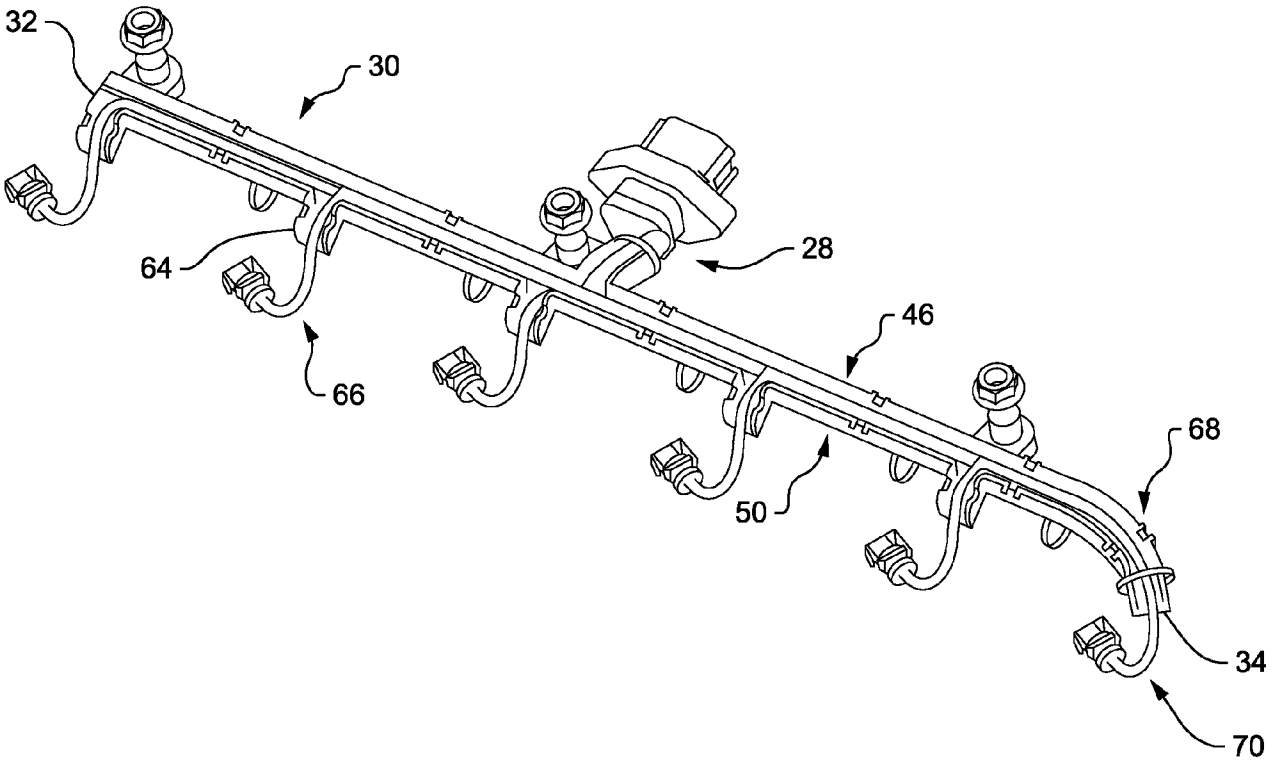

FIG. 5 is another perspective view of a tray configured to support a fuel injector wiring harness, and the fuel injector wiring harness, that may be utilized with the cylinder head of FIGS. 2 and 3 looking from a valve-side to a rocker-side.

Figure 6:
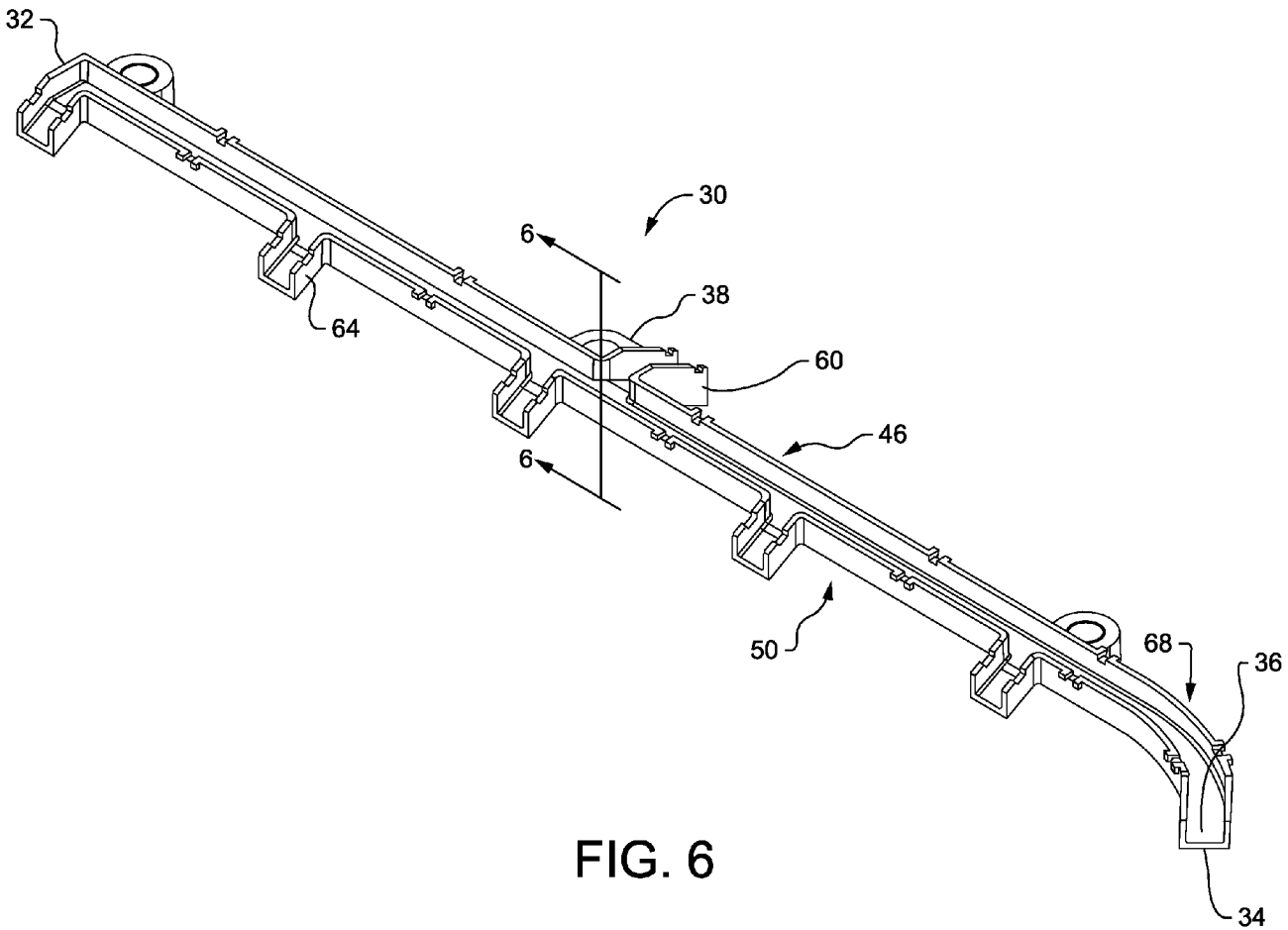

FIG. 6 is a perspective view of a tray configured to support a fuel injector wiring harness according to FIGS. 4 and 5, with the fuel injector wiring harness removed, looking from a valve-side to a rocker-side.

Figure 7:
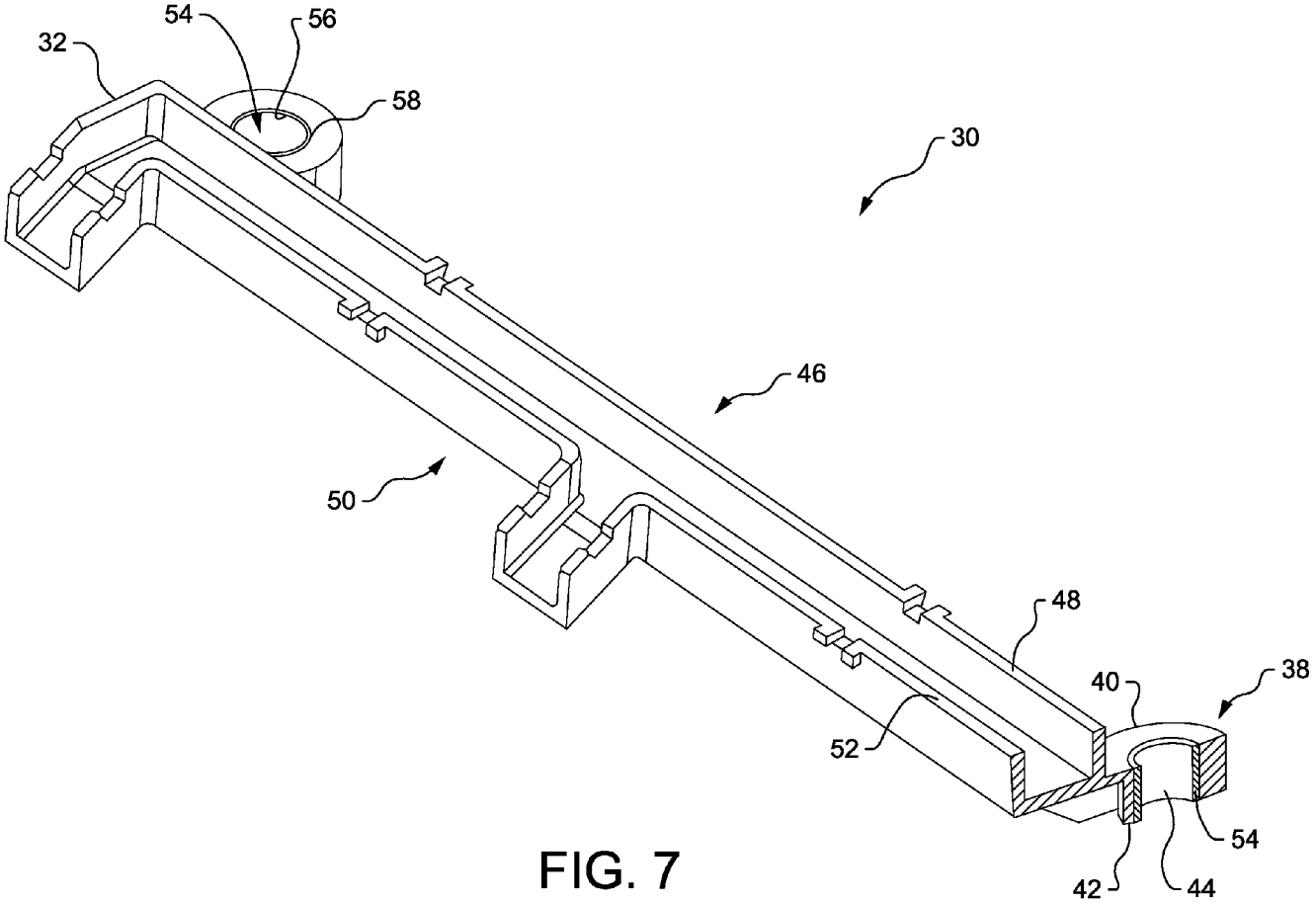

FIG. 7 is cross-sectional view of a tray configured to support a fuel injector wiring harness according to FIGS. 4 and 5, with the fuel injector wiring harness removed, along line 6-6 of FIG. 6.

DETAILED DESCRIPTION OF THE DISCLOSURE

Various aspects of the disclosure will now be described with reference to the drawings, wherein like reference numbers refer to like elements, unless specified otherwise. Referring now to the drawings and with specific reference to FIG. 1, an internal combustion engine constructed in accordance with the present disclosure is generally referred to by reference numeral 10. The internal combustion engine 10 may include an engine block 12 and a cylinder head 14 supported by the engine block 12. Moreover, the internal combustion engine 10 may include a valve cover 16 supported by the cylinder head 14. The internal combustion engine 10 may be provided in any number of different forms including, but not limited to, Otto cycle engines, Diesel cycle engines, and gas turbine engines.

Referring to FIGS. 2 and 3, perspective views of the cylinder head 14 that may be utilized with the internal combustion engine 10 of FIG. 1, with valve cover 16 removed, are depicted. As seen therein, the cylinder head 14 may include a valve system 18 configured to actuate between an open position and a closed position and thereby allow entry of fuel and air into cylinders in the engine block 12. Moreover, the cylinder head 14 may include a rocker system 20 operationally engaged with the valve system 18. The rocker system 20 may be configured to actuate the valve system 18 between the open position and the closed position described above, and thereby allowing entry of the fuel and the air into the cylinders in the engine block 12. More particularly, however, the rocker system 20 may include a rocker arm support 22, and furthermore, a stud 24 may upwardly extend from the rocker arm support 22. As described herein the portion of the stud 24 upwardly extending from the rocker arm support 22 may be threaded, however other mechanisms for removable mounting may be provided.

Moreover, and turning particularly to FIG. 3, the cylinder head 14 may also include a fuel-injector 26 configured to deliver fuel into the cylinders in the engine block 12. Referring now to both FIGS. 2 and 3, the cylinder head 14 may additionally include a fuel injector wiring harness 28, and the fuel injector wiring harness 28 may be configured to convey an electrical signal to the fuel-injector 26. In response to the electrical signal, the fuel-injector 26 may deliver fuel into the cylinders in the engine block 12. Moreover, the cylinder head 14 may include a tray 30 which may be configured to support the fuel injector wiring harness 28. More specifically, the tray 30 may be configured to support the fuel injector wiring harness 28 above the rocker arm support 22. As the tray 30 is located in the cylinder head 14 where it is exposed to elevated temperatures, fuel and oil, it may be manufactured from a material that is heat resistant, in addition to being fuel and oil resistant.

Perspective views of the tray 30 configured to support the fuel injector wiring harness 28 above the rocker arm support 22, along with the wiring harness 28, are depicted in FIGS. 4 and 5. As depicted therein, the tray 30 may include a first end 32 and a second end 34 opposite the first end 32.

Turning to FIG. 6, a perspective view of the tray 30 configured to support the fuel injector wiring harness 28, with the fuel injector wiring harness 28 removed, is depicted. As shown therein, the tray 30 may include a bottom wall 36 extending between the first end 32 and the second end 34, and the bottom wall 36 may be configured to support the fuel injector wiring harness 28 above the rocker arm support 22. The tray 30 may additionally include a tab 38 outwardly extending from the tray 30. Referring now to the cross-sectional view in FIG. 7 of the tray 30 along line 6-6 of FIG. 6, the tab 38 may include a top surface 40, a bottom surface 42, and an aperture 44 extending between the top surface 40 and the bottom surface 42. Now turning back to FIGS. 2 and 3, the aperture 44 may be configured to circumscribe the stud 24 that is threaded and upwardly extending from the rocker arm support 22. Of course, such a configuration is only one example, and other mechanisms for mounting the tray 30, including, but not limited to, alternatively shaped tabs 38, are possible.

With reference now to FIGS. 4-7, the tray 30 may further include a rocker-side 46 and the tab 38 may outwardly extend from the rocker-side 46. Moreover, and turning to FIG. 7, the tray 30 may include a rocker-side wall 48 that upwardly extends from the bottom wall 36 between the first end 32 and the second end 34. The rocker-side wall 48 may be configured to retain the fuel injector wiring harness 28 above the rocker arm support 22, and furthermore, the tab 38 may outwardly extend from the rocker-side wall 48.

Furthermore, the tray 30 may include a valve-side 50 and in an alternative embodiment the tab 38 may outwardly extend from the valve-side 50. Moreover, as depicted in FIG. 7, the tray 30 may also include a valve-side wall 52. The valve-side wall 52 may upwardly extend from the bottom wall 36 between the first end 32 and the second end 34. Moreover, the valve-side wall 52 may be configured to retain the fuel injector wiring harness 28 above the rocker arm support 22. In an alternative embodiment, the tab 38 may extend from the valve-side wall 52.

The tray 30 may also include a load ring 54 to maintain proper spacing between the tray 30 and the rocker arm support 22. Turning to FIG. 7, the load ring 54 may include an inner diameter 56 and an outer diameter 58. Moreover, the load ring 54 may be positioned inside the aperture 44 so that the outer diameter 58 abuts the aperture 44, and the inner diameter 56 may be configured to circumscribe the stud 24 upwardly extending from the rocker arm support 22. The load ring 54 may be made of a material different than the tray 30, such as a metal or metal alloy, and therefore the load ring 54 may be configured to maintain a predetermined distance between the bottom wall 36 and the rocker arm support 22 when placed under a compressive stress.

Further, as depicted in FIGS. 4 and 6, the tray 30 may include a rocker-side support 60 that outwardly extends from the tray 30. The rocker-side support 60 may be configured to support a first portion 62 of the fuel injector wiring harness 28 extending between the bottom wall 36 and the valve cover 16. In addition, as is depicted FIGS. 5 and 6, the tray 30 may include a valve-side support 64. The valve-side support 64 may outwardly extend from the bottom wall 36 and may be configured to support a second portion 66 of the fuel injector wiring harness 28 extending between the bottom wall 36 and the fuel-injector 26. Moreover, as is seen in these figures, the tray 30 may include a curved portion 68 positioned at the second end 34 configured to support a third portion 70 the fuel injector wiring harness 28. The third portion 70 of the fuel injector wiring harness 28 may extend between the bottom wall 36 and the fuel-injector 26 positioned adjacent the second end 34.

INDUSTRIAL APPLICABILITY

In general, the present disclosure may find use in many industrial applications including, but not limited to, internal combustion engines, such as, but not limited to, Otto cycle, Diesel cycle and gas turbine engines. More specifically, the present disclosure finds usefulness in an internal combustion engine 10 utilizing a fuel-injector 26 located in a cylinder head 14. Specifically, the present disclosure finds usefulness by supporting a fuel injector wiring harness 28 in a tray 30 that is fixedly attached to a rocker arm support 22 of the rocker system 20, thereby easing repair and maintenance of the cylinder head 14.

The present disclosure also reduces part count, complexity and cost of manufacture. For example, prior wiring harnesses were mounted below a valve cover in the region of the valve cover base. This required utilizing a separate valve cover base and valve cover. Such an approach added manufacturing steps and cost, while also adding additional components subject to failure. The present disclosure, on the other hand, reduces parts, removes at least one seal, simplifies manufacturability and increases reliability.

The above description is meant to be representative only, and thus modifications may be made to the embodiments described herein without departing from the scope of the disclosure. Thus, these modifications fall within the scope of present disclosure and are intended to fall within the appended claims.

What is claimed is:

1. A tray configured to support a fuel injector wiring harness, comprising:

a first end;

a second end opposite the first end;

a bottom wall, the bottom wall extending between the first end and the second end, the bottom wall configured to support the fuel injector wiring harness above a rocker arm support; and a tab outwardly extending from the tray, the tab including a top surface, a bottom surface opposite the top surface, and an aperture extending between the top surface and the bottom surface, the aperture configured to circumscribe a stud upwardly extending from the rocker arm support.

2. The tray configured to support the fuel injector wiring harness according to claim 1, further including a rocker-side, and wherein the tab outwardly extending from the tray outwardly extends from the rocker-side.

3. The tray configured to support the fuel injector wiring harness according to claim 2, further including a rocker-side wall, the rocker-side wall upwardly extending from the bottom wall between the first end and the second end, the rocker-side wall configured to retain the fuel injector wiring harness above the rocker arm support, and wherein the tab outwardly extending from the tray outwardly extends from the rocker-side wall.

4. The tray configured to support the fuel injector wiring harness according to claim 1, further including a valve-side, and wherein the tab outwardly extending from the tray outwardly extends from the valve-side.

5. The tray configured to support the fuel injector wiring harness according to claim 4, further including a valve-side wall, the valve-side wall upwardly extending from the bottom wall between the first end and the second end, the valve-side wall configured to retain the fuel injector wiring harness above the rocker arm support, and wherein the tab outwardly extending from the tray outwardly extends from the valve-side wall.

6. The tray configured to support the fuel injector wiring harness according to claim 1, further including a load ring, the load ring including an inner diameter and an outer diameter, the load ring positioned inside the aperture so that the outer diameter abuts the aperture, the inner diameter configured to circumscribe the stud, the load ring configured to maintain a predetermined distance between the bottom wall and the rocker arm support.

7. The tray configured to support the fuel injector wiring harness according to claim 1, further including a rocker-side support, the rocker-side support outwardly extending from the tray, the rocker-side support configured to support a first portion of the fuel injector wiring harness, the first portion of the fuel injector wiring harness extending between the bottom wall and a valve cover.

8. The tray configured to support the fuel injector wiring harness according to claim 1, further including a valve-side support, the valve-side support outwardly extending from the bottom wall, the valve-side support configured to support a second portion of the fuel injector wiring harness, the second portion of the fuel injector wiring harness extending between the bottom wall and a fuel injector.

9. The tray configured to support the fuel injector wiring harness according to claim 1, further including a curved portion positioned at the second end, the curved portion configured to support a third portion of the fuel injector wiring harness, the third portion of the fuel injector wiring harness extending between the bottom wall and a fuel injector positioned adjacent the second end.

10. A cylinder head, comprising:

a valve system;

a rocker system operationally engaged with the valve system, the rocker system including a rocker arm support;

a stud upwardly extending from the rocker arm support;

a fuel-injector;

a fuel injector wiring harness configured to convey an electrical signal to the fuel-injector;

a tray configured to support the fuel injector wiring harness above the rocker arm support, including a first end, a second end opposite the first end, a bottom wall extending between the first end and the second end, and a tab outwardly extending from the tray, the tab including a top surface and a bottom surface opposite the top surface and having an aperture extending therethrough configured to circumscribe the stud upwardly extending from the rocker arm support.

11. The cylinder head according to claim 10, wherein the tray configured to support the fuel injector wiring harness above the rocker arm support further includes a rocker-side, wherein the tab outwardly extending from the tray outwardly extends from the rocker-side, wherein the tray configured to support the fuel injector wiring harness above the rocker arm support further includes a rocker-side wall, the rocker-side wall upwardly extending from the bottom wall between the first end and the second end, the rocker-side wall configured to retain the fuel injector wiring harness above the rocker arm support, and wherein the tab outwardly extending from the tray outwardly extends from the rocker-side wall.

12. The cylinder head according to claim 10, wherein the tray configured to support the fuel injector wiring harness above the rocker arm support further includes a valve-side, wherein the tab outwardly extending from the tray outwardly extends from the valve-side, wherein the tray configured to support the fuel injector wiring harness above the rocker arm support further includes a valve-side wall, the valve-side wall upwardly extending from the bottom wall between the first end and the second end, the valve-side wall configured to retain the fuel injector wiring harness above the rocker arm support, and wherein the tab outwardly from the tray outwardly extends from the valve-side wall.

13. The cylinder head according to claim 10, wherein the tray configured to support the fuel injector wiring harness above the rocker arm support further includes a load ring, the load ring including an inner diameter and an outer diameter, the load ring positioned inside the aperture so that the outer diameter abuts the aperture, the inner diameter configured to circumscribe the stud upwardly extending from the rocker arm support, and wherein the load ring is configured to maintain a predetermined distance between the bottom wall and the rocker arm support.

14. The cylinder head according to claim 10, wherein the tray configured to support the fuel injector wiring harness above the rocker arm support further includes a rocker-side support, the rocker-side support outwardly extending from the tray, the rocker-side support configured to support a first portion of the fuel injector wiring harness, the first portion of the fuel injector wiring harness extending between the bottom wall and a valve cover.

15. The cylinder head according to claim 14, wherein the tray configured to support the fuel injector wiring harness above the rocker arm support further includes a valve-side support, the valve-side support outwardly extending from the bottom wall, the valve-side support configured to support a second portion of the fuel injector wiring harness, the second portion of the fuel injector wiring harness extending between the bottom wall and the fuel-injector.

16. The cylinder head according to claim 15, wherein the tray configured to support the fuel injector wiring harness above the rocker arm support further includes a curved portion positioned at the second end, the curved portion configured to support a third portion of the fuel injector wiring harness, the third portion of the fuel injector wiring harness extending between the bottom wall and the fuel-injector positioned adjacent the second end.

17. An internal combustion engine, comprising:

an engine block;

a cylinder head supported by the engine block, the cylinder head including a valve system, a rocker system operationally engaged with the valve system including a rocker arm support and a stud upwardly extending from the rocker arm support, a fuel-injector, a fuel injector wiring harness configured to convey an electrical signal to the fuel-injector, and a tray configured to support the fuel injector wiring harness above the rocker arm support, wherein the tray includes a first end, a second end opposite the first end, and a bottom wall extending between the first end and the second end, and wherein the tray includes a tab outwardly extending from the tray including a top surface, a bottom surface opposite the bottom surface and having an aperture extending therethrough configured to circumscribe the stud upwardly extending from the rocker arm support.

18. The internal combustion engine according to claim 17, wherein the tray configured to support the fuel injector wiring harness above the rocker arm support further includes a rocker-side and a rocker-side wall upwardly extending from the bottom wall between the first end and the second end configured to retain the fuel injector wiring harness above the rocker arm support, wherein the tray configured to support the fuel injector wiring harness above the rocker arm support further includes a valve-side and a valve-side wall upwardly extending from the bottom wall between the first end and the second end configured to retain the fuel injector wiring harness above the rocker arm support, and wherein the tab outwardly extends from the valve-side.

19. The internal combustion engine according to claim 18, wherein the tray configured to support the fuel injector wiring harness above the rocker arm support further includes a load ring, the load ring including an inner diameter and an outer diameter, the load ring positioned inside the aperture so that the outer diameter abuts the aperture, the inner diameter configured to circumscribe the stud upwardly extending from the rocker arm support, and wherein the load ring is configured to maintain a predetermined distance between the bottom wall and the rocker arm support.

20. The internal combustion engine according to claim 19, wherein the tray configured to support the fuel injector wiring harness above the rocker arm support further includes a rocker-side support, the rocker-side support outwardly extending from the tray, the rocker-side support configured to support a first portion of the fuel injector wiring harness, the first portion of the fuel injector wiring harness extending between the bottom wall and a valve cover, and wherein the tray configured to support the fuel injector wiring harness above the rocker arm support further includes a valve-side support, the valve-side support outwardly extending from the bottom wall, the valve-side support configured to support a second portion of the fuel injector wiring harness, the second portion of the fuel injector wiring harness extending between the bottom wall and the fuel-injector.

* * * * *